US008807802B2

(12) United States Patent
Li et al.

(10) Patent No.: US 8,807,802 B2
(45) Date of Patent: Aug. 19, 2014

(54) REFLECTOR AND A LIGHTING DEVICE HAVING THE SAME

(75) Inventors: Aiai Li, Guangdong (CN); Yabin Luo, Guangdong (CN); Tengzhi Qin, Guangdong (CN); Hui Wu, Guangdong (CN)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/819,771

(22) PCT Filed: Aug. 8, 2011

(86) PCT No.: PCT/EP2011/063633

§ 371 (c)(1), (2), (4) Date: Feb. 28, 2013

(87) PCT Pub. No.: WO2012/028420

PCT Pub. Date: Mar. 8, 2012

(65) Prior Publication Data

US 2013/0170226 A1 Jul. 4, 2013

(30) Foreign Application Priority Data

Aug. 30, 2010 (CN) ..... 2010 1 0273566

(51) Int. Cl.
*F21V 17/02* (2006.01)

(52) U.S. Cl.
CPC ..... *F21V 17/02* (2013.01)
USPC ..... 362/322; 362/319

(58) Field of Classification Search
CPC ..... F21V 17/02
USPC ..... 362/322
See application file for complete search history.

(56) References Cited

U.S. PATENT DOCUMENTS

| | | | | |
|---|---|---|---|---|
| 3,239,660 | A * | 3/1966 | Hall, Jr. | 362/234 |
| 8,282,244 | B2 | 10/2012 | Römelt | |
| 2009/0231856 | A1 | 9/2009 | Householder et al. | |
| 2009/0323330 | A1 | 12/2009 | Gordin et al. | |
| 2010/0195326 | A1 | 8/2010 | Boxler et al. | |

FOREIGN PATENT DOCUMENTS

| | | | |
|---|---|---|---|
| CN | 101676601 | A | 3/2010 |
| WO | 2004102064 | A1 | 11/2004 |

OTHER PUBLICATIONS

Chinese Office Action for corresponding application No. 201010273566.3, dated Nov. 22, 2013.

* cited by examiner

*Primary Examiner* — Mary Ellen Bowman

(57) ABSTRACT

A reflector for a lighting device is provided. The reflector may include: a plurality of reflecting bodies each having a plurality of internal reflecting facets; wherein the plurality of reflecting bodies are arranged to rotate by different rotation angles around their respective rotation axes, so as to be capable of compensating unsmooth light distribution caused by the internal reflecting facets.

8 Claims, 5 Drawing Sheets

REFLECTOR AND A LIGHTING DEVICE HAVING THE SAME

RELATED APPLICATIONS

The present application is a national stage entry according to 35 U.S.C. §371 of PCT application No.: PCT/EP2011/063,633 filed on Aug. 8, 2011, which claims priority from Chinese application No.: 201010273566.3 filed on Aug. 30, 2010.

TECHNICAL FIELD

Various embodiments relate to a reflector for a lighting device. In addition, various embodiments relate to a lighting device having such reflector.

BACKGROUND

It is well-known that the reflector having a plurality of reflecting bodies is commonly used in the illumination products. In the prior art, the reflector uses its own reflecting facets to mix the light. If the reflecting bodies with the same internal reflecting facets of the reflector are mounted in a consistent direction, the light pattern obtained by the reflector is not a smooth circular ring, but a ring-like polygon. In order to solve the above problem, in the prior art, a solution of a diffusive cover is provided. As shown in FIG. 1, the diffusive cover 2 (such as the diffusive cover fabricated by materials such as PC, PMMA normal in the market) is used to cover the surface of the reflector 11 having a plurality of reflecting bodies 1, so that the light can be well mixed, but the shortcoming is the loss of a lot of light in the cover 2. Another solution is to make the peripheral surface 3 of the reflecting body 1 to be rough, as shown in FIG. 2, by treating the peripheral surface 3 of the reflecting body 1 by sand blasting, thereby, the light also can be well mixed, but due to the sand blasting, the reflectivity is much lower than that of the reflecting body with a smooth surface.

SUMMARY

Various embodiments provide a reflector for the lighting device that does not affect the reflectivity or the quantity of light and is capable of smoothing the shape of the light pattern. Various embodiments provide a reflector with no need of any additional parts. The reflector according to various embodiments may include: a plurality of reflecting bodies each having a plurality of internal reflecting facets, wherein the plurality of reflecting bodies are arranged to rotate by different rotation angels around their respective rotation axes, so as to be capable of compensating the unsmooth light distribution caused by the internal reflecting facets.

The inventive concept of the present invention lies in that the unsmooth light distribution is caused by the facet angles of the internal reflecting facets; therefore, the unsmooth light distribution is compensated by adjusting the rotation angles of the plurality of reflecting bodies around their respective rotation axes in the array of the reflecting bodies. The adjustment of the rotation angles of respective reflecting bodies generally should ensure that the facet angle of one internal reflecting facet is at least partially compensated. It should be indicated that the rotation of the plurality of reflecting bodies around their respective rotation axes is in the plane where the array of the reflecting bodies is located. The rotation axis refers to the self-rotation axis of the reflecting body, and the rotation axes should be substantially parallel.

According to one preferred solution of the present invention, the plurality of reflecting bodies are sequentially arranged with the predetermined rotation angle difference in the clockwise or anticlockwise direction. The plurality of reflecting bodies are axisymmetrically, preferably centrosymmetrically, arranged. Each reflecting body is rotated by a predetermined angle with respect to the previous reflecting body in the clockwise or anticlockwise direction in the plane where the reflector is located, such that an array of the reflecting bodies angularly staggered is formed.

For the sake of the best compensation effect, i.e. to compensate one facet angle of the internal reflecting facets, the rotation angle difference between the next reflecting body and the previous reflecting body in the reflector is $$A = \frac{\theta}{n},$$

in which n is the number of the reflecting bodies, and θ is the facet angle of the internal reflecting facet (i.e. the central angle corresponding to the lower edge of the internal reflecting facet). The predetermined angle to be rotated by depends upon the number of the reflecting bodies and the facet angle of the internal reflecting facet. The compensating function of the predetermined rotation angle difference can be seen apparently through simple analysis of the number of the reflecting bodies and facet angles thereof.

Preferably, the plurality of reflecting bodies are arranged into an array to better realize the compensating function.

Advantageously, the reflector further comprises a substrate provided with openings for correspondingly mounting the plurality of reflecting bodies. The reflecting bodies can be fixedly positioned in the substrate with these corresponding openings so as to form a mechanically stable structure to ensure a consistent angle difference between the reflecting bodies.

Preferably, the reflecting bodies are cup-shaped. The cup-shaped reflecting body has favorable reflectivity, saves the space and is easy to be fabricated. Of course, there may be some reflecting bodies with other shapes suitable to the present invention.

Advantageously, it is put forward that the inner walls of the reflecting bodies are coated with the reflecting coating. The reflectivity is further improved by coating the reflecting coating on the inner walls of the reflecting bodies.

The present invention further provides a lighting device using the reflector according to the present invention. With such lighting device, the smooth light distribution can be obtained without loss of luminous energy.

The reflector and lighting device according to the present invention are capable of providing smoother light distribution with high optical efficiency, do not need any other optical parts to mix the light, and have the advantage of low cost.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
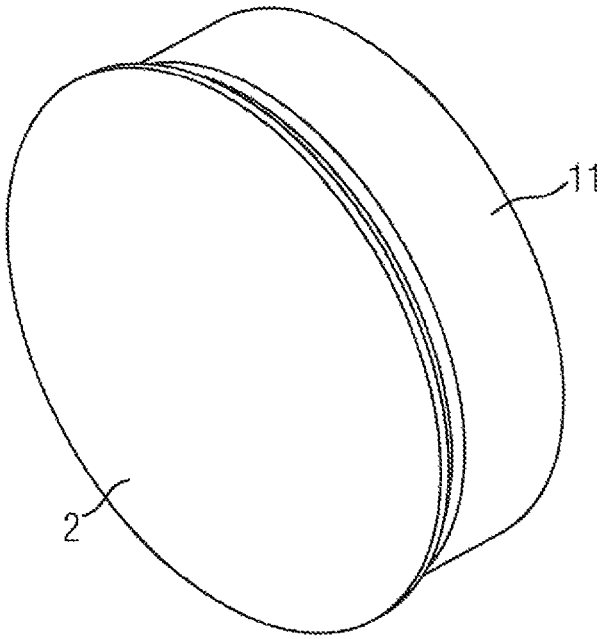
FIG. 1 shows the solution of the diffusive cover in the prior art.
Figure 2:
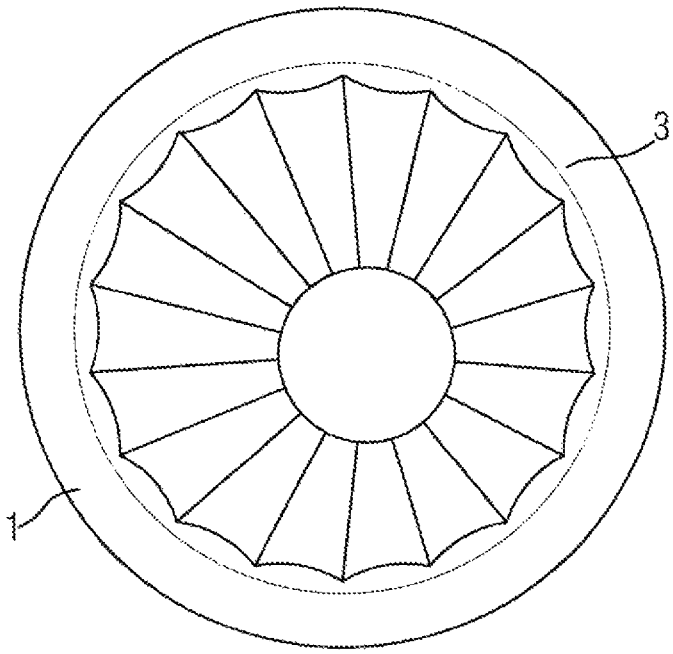
FIG. 2 shows the solution of making the peripheral surface to be rough in the prior art.
Figure 3:
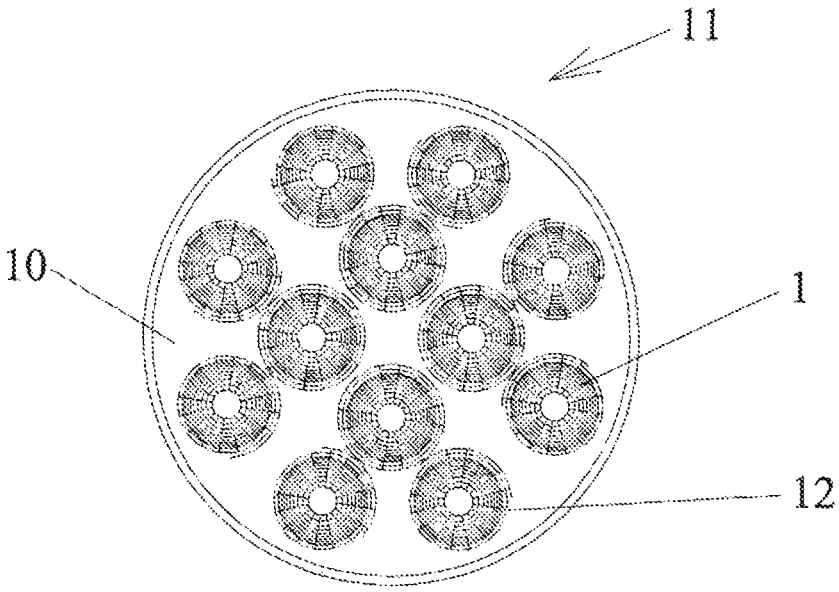
FIG. 3 shows a reflector mounted with a plurality of reflecting bodies.

FIG. 3 shows the reflector mounted with a plurality of reflecting bodies according to the present invention. The reflector 11 according to the present invention in FIG. 3 comprises a substrate 10 with a plurality of openings 12 and a plurality of reflecting bodies 1. The plurality of reflecting bodies 1 can be fixedly positioned in the substrate 10 with the plurality of openings 12. The plurality of reflecting bodies 1 are arranged in an array shape in the substrate 10, usually axisymmetrically, preferably centrosymmetrically, and of course, they also can be randomly arranged.

Figure 4:
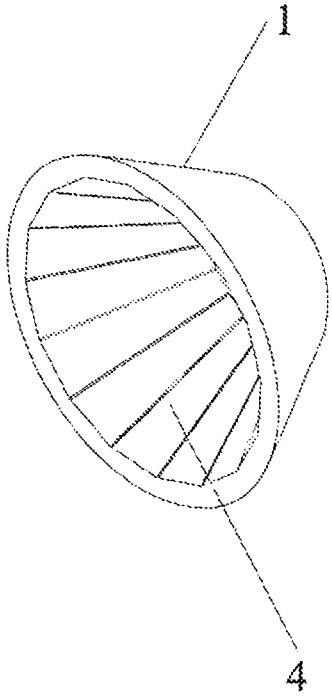
FIG. 4 shows a reflecting body with a plurality of internal reflecting facets.

FIG. 4 shows a reflector 1 with a plurality of internal reflecting facets. The reflecting bodies 1 are cup-shaped with their inner walls designed as a plurality of internal reflecting facets 4 for reflecting the light. In order to improve the reflectivity of the reflecting bodies 1, the reflecting coating can be coated on the internal reflecting facets 4. Each facet 4 has edges to form an approximately circular polygon light pattern. Each edge is corresponding to an identical angle θ. In this embodiment, the reflecting body 1 has 18 facets, then, θ is 20°.

According to the present invention, the arrangement of the plurality of reflecting bodies can be adjusted to avoid the polygon light pattern, i.e. the plurality of reflecting bodies are arranged to rotate by different rotation angles around their respective rotation axes. Next, several preferred embodiments of the present invention are illustrated.

Figure 5:
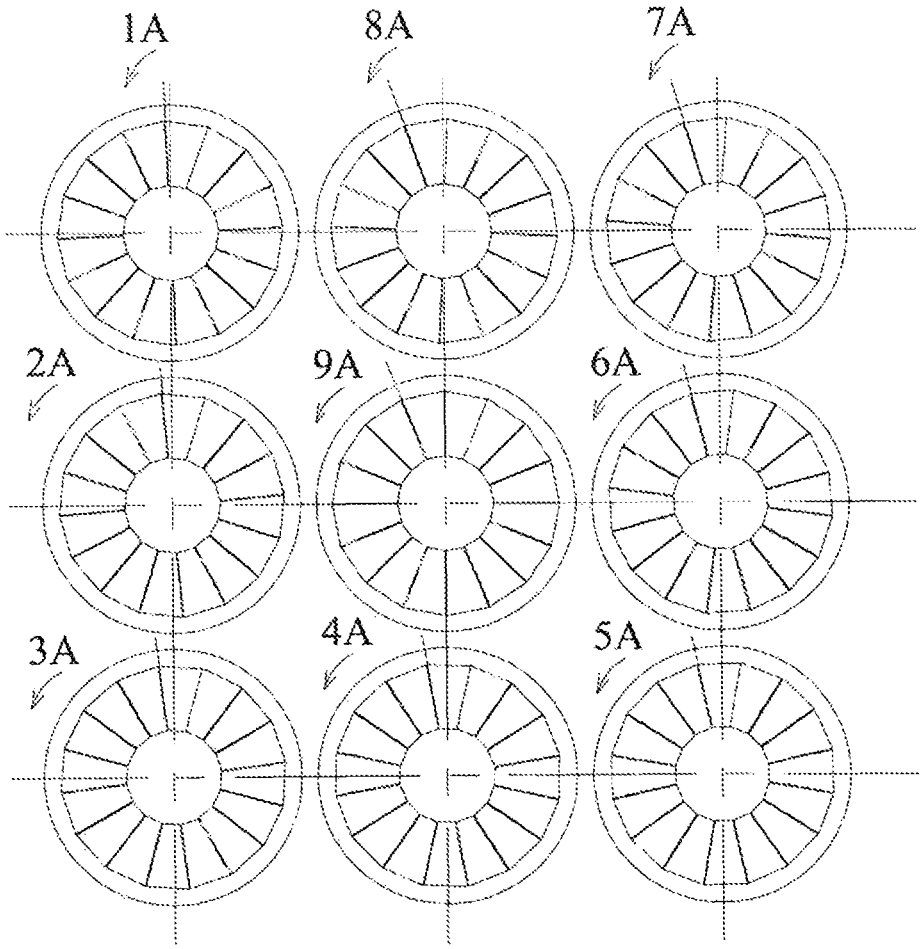
FIG. 5 shows the arrangement plan of nine reflecting bodies according to the present invention.

FIG. 5 shows the arrangement plan of nine reflecting bodies according to the present invention. As shown in the figure, the nine reflecting bodies 1 are centrosymmetrically arranged. The predetermined angle difference A can be calculated according to $$A = \frac{\theta}{n}$$

(n=9 herein). The rotation angle difference between the next reflecting body and the previous reflecting body in the array in the anticlockwise direction is A. The rotation situation of each reflecting body is observed starting from the first reflecting body at the top left corner in the anticlockwise direction. The first reflecting body is rotated by the angle A around its self-rotation axis in the anticlockwise direction, the second reflecting body is rotated by an angle 2A in the anticlockwise direction, i.e. it is rotated by the angle A with respect to the first reflecting body; and the third reflecting body on the bottom left is rotated by an angle 3A in the anticlockwise direction, i.e. it is also rotated by the angle A with respect to the second reflecting body in the anticlockwise direction. Similarly, the remaining fourth to ninth reflecting bodies are rotated by angles 4A to 9A, respectively, in the anticlockwise direction, i.e. they are rotated by the angle A, respectively, with respect to their respective previous reflecting body.

Figure 6:
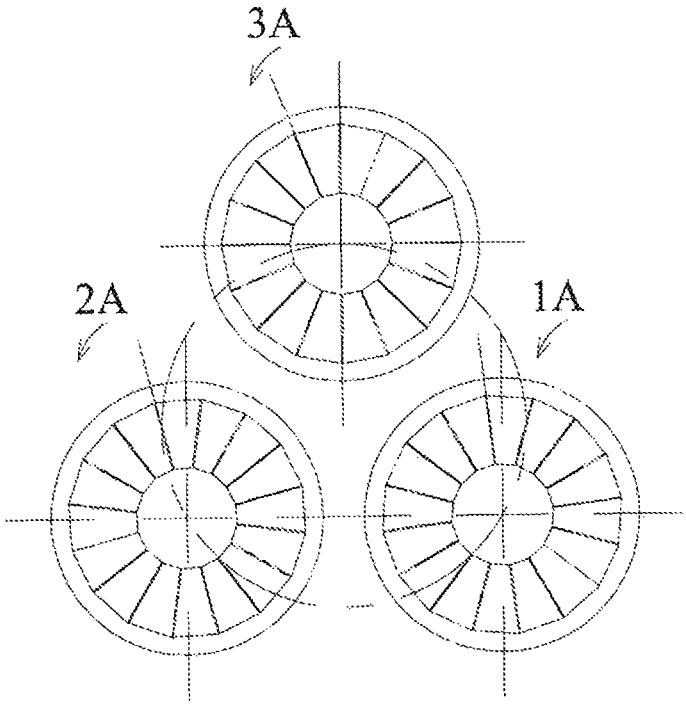
FIG. 6 shows the arrangement plan of three reflecting bodies according to the present invention.

FIG. 6 shows the arrangement plan of three reflecting bodies according to the present invention. As shown in the figure, the three reflecting bodies 1 are axisymmetrically arranged. The predetermined angle difference A can be calculated according to $$A = \frac{\theta}{n}$$

(n=3 herein). The rotation angle difference between the next reflecting body and the previous reflecting body in the array in the clockwise direction is A. The rotation situation of each reflecting body is observed starting from the first reflecting body on the top in the clockwise direction. The first reflecting body is rotated by the angle A in the anticlockwise direction, the second reflecting body on the lower left is rotated by an angle 2A in the anticlockwise direction, i.e. it is rotated by the angle A with respect to the first reflecting body in the anticlockwise direction; and the third reflecting body on the top is rotated by an angle 3A in the anticlockwise direction, i.e. it is also rotated by the angle A with respect to the second reflecting body in the anticlockwise direction.

Figure 7:
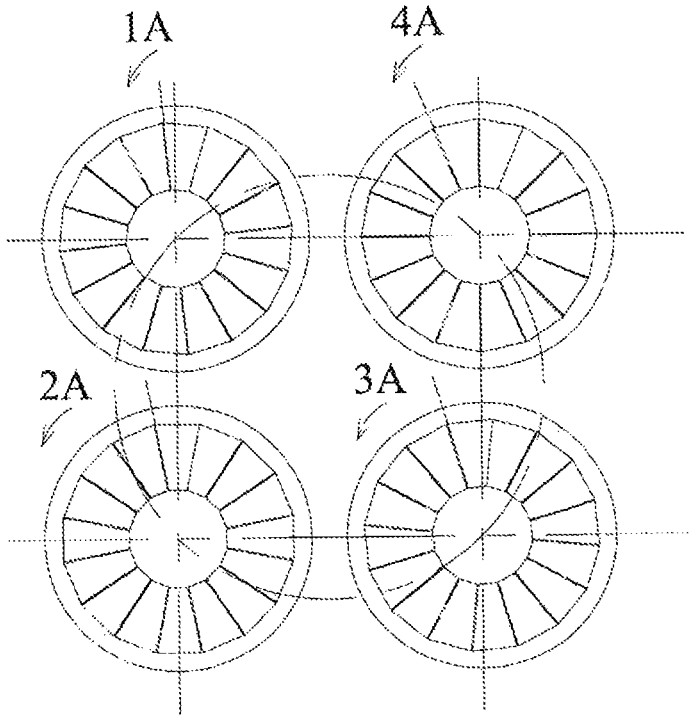
FIG. 7 shows the arrangement plan of four reflecting bodies according to the present invention.

FIG. 7 shows the arrangement plan of four reflecting bodies according to the present invention. As shown in the figure, the four reflecting bodies 1 are centrosymmetrically arranged. The predetermined angle difference A can be calculated according to $$A = \frac{\theta}{n}$$

(n=4 herein). The rotation angle difference between the next reflecting body and the previous reflecting body in the array in the anticlockwise direction is A. The rotation situation of each reflecting body is observed starting from the first reflecting body on the top left in the clockwise direction. The first reflecting body is rotated by the angle A in the anticlockwise direction, the second reflecting body on the bottom left is rotated by an angle 2A in the anticlockwise direction, i.e. it is rotated by the angle A with respect to the first reflecting body in the anticlockwise direction; and the third reflecting body on the lower right is rotated by an angle 3A in the anticlockwise direction, i.e. it is also rotated by the angle A with respect to the second reflecting body in the anticlockwise direction. Similarly, the fourth reflecting body on the top right is also rotated by an angle 4A in the anticlockwise direction.

Figure 8:
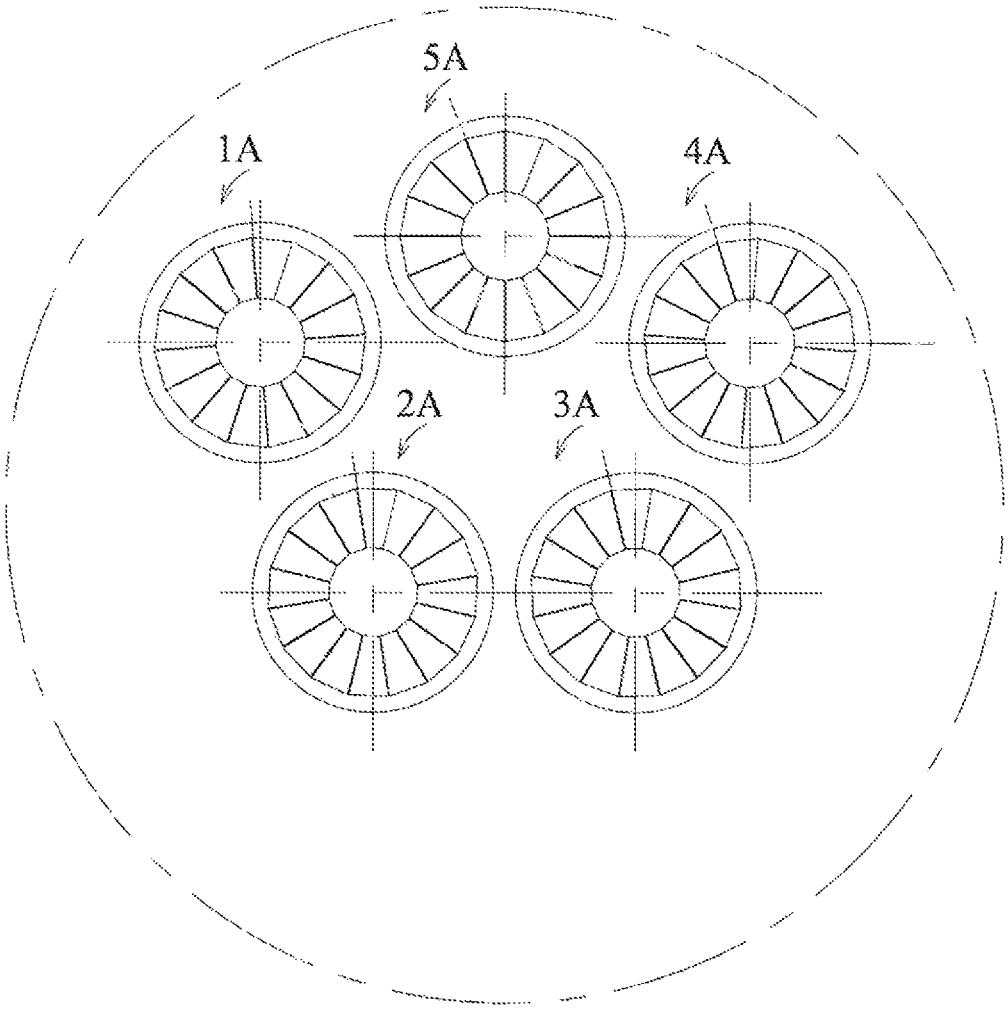
FIG. 8 shows the arrangement plan of five reflecting bodies according to the present invention.

FIG. 8 shows the arrangement plan of five reflecting bodies according to the present invention. As shown in the figure, the five reflecting bodies 1 are axisymmetrically arranged. The predetermined angle difference A can be calculated according to $$A = \frac{\theta}{n}$$

(n=5 herein). The rotation angle difference between the next reflecting body and the previous reflecting body in the array in the anticlockwise direction is A. The rotation situation of each reflecting body is observed starting from the first reflecting body on the top left in the clockwise direction. The first reflecting body 1 on the top left is rotated by the angle A in the anticlockwise direction, the second reflecting body on the bottom left is rotated by an angle 2A in the anticlockwise direction, i.e. it is rotated by the angle A with respect to the first reflecting body in the anticlockwise direction. Similarly, the remaining third to fifth reflecting bodies are also rotated by angles 3A to 5A, respectively, in the anticlockwise direction, i.e. they are rotated by the angle A with respect to their respective previous reflecting body, respectively, in the anticlockwise direction.

It should be noted that above examples are preferable embodiment. It is better to avoid that the number of facets equals the number of reflectors (i.e n and 360°/θ should be different)

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

REFERENCE SIGNS

1 reflecting body
2 diffusive cover
3 peripheral surface
4 internal reflecting facet
10 substrate
11 reflector
12 opening
A predetermined angle difference
θ facet angle of internal reflecting facet
n number of reflecting bodies

The invention claimed is:

1. A reflector for a lighting device, the reflector comprising:

a plurality of reflecting bodies each having a plurality of internal reflecting facets;

wherein the plurality of reflecting bodies are arranged by different rotation angles around their respective rotation axes, so as to be capable of compensating unsmooth light distribution caused by the internal reflecting facets, and wherein a rotation angle difference between successive reflecting bodies is A=θ/n, wherein, n is the number of the reflecting bodies, and θ is a facet angle of the internal reflecting facet.

2. The reflector according to claim 1, wherein the plurality of reflecting bodies are sequentially arranged with the rotation angle difference being predetermined in a clockwise or anticlockwise direction.

3. The reflector according to claim 1, wherein the plurality of reflecting bodies are axisymmetrically arranged.

4. The reflector according to claim 3, wherein the plurality of reflecting bodies are centrosymmetrically arranged.

5. The reflector according to claim 1, wherein the plurality of reflecting bodies are arranged into an array.

6. The reflector according to claim 1, further comprising:

a substrate provided with openings for correspondingly mounting the plurality of reflecting bodies.

7. The reflector according to claim 1, wherein the reflecting bodies are cup-shaped reflecting bodies.

8. A lighting device, comprising:

a reflector, comprising:

a plurality of reflecting bodies each having a plurality of internal reflecting facets;

wherein the plurality of reflecting bodies are arranged to rotate by different rotation angles around their respective rotation axes, so as to be capable of compensating unsmooth light distribution caused by the internal reflecting facets, and wherein a rotation angle difference between successive reflecting bodies is A=θ/n, wherein, n is the number of the reflecting bodies, and θ is a facet angle of the internal reflecting facet.

* * * * *